United States Patent [19]

Tsuchiya

[11] 4,442,752

[45] Apr. 17, 1984

[54] ELECTRONIC METRONOME

[76] Inventor: Paul Tsuchiya, 2226 Mohegan Dr., Apt. 301, Falls Church, Va. 22043

[21] Appl. No.: 315,420

[22] Filed: Jan. 20, 1982 (Under 37 CFR 1.47)

[51] Int. Cl.[3] ..... G04F 5/02

[52] U.S. Cl. ..... 84/484

[58] Field of Search ..... 84/484; 340/384 E; 368/10, 12, 109, 248, 251

[56] References Cited

U.S. PATENT DOCUMENTS 4,192,133 3/1980 Komaki ..... 368/248 X

*Primary Examiner*—William B. Perkey

*Attorney, Agent, or Firm*—Harold Gell

[57] ABSTRACT

An electronic metronome is presented which utilizes a microcomputer adapted to permit precise selection of a beat frequency via a digital keyboard or alternately by way of a stop watch timer which measures an interval between first and second beats activated by the metronome operator and causes the metronome to duplicate the beat frequency timing thus measured. The device has the added capability of providing a selected one of a plurality of tones for pitch comparison and providing a stop watch function via a digital indicating panel which serves the dual function of indicating selected beat frequency during normal metronome functions.

9 Claims, 12 Drawing Figures

| X | RAM 0 (X=0) | | | | RAM 1 (X=1) | | | | RAM 2 (X=2) | | | |
|---|---|---|---|---|---|---|---|---|---|---|---|---|
| Y / B | 0 | 1 | 2 | 3 | 0 | 1 | 2 | 3 | 0 | 1 | 2 | 3 |
| 0 | TIMING | | | | INPUT | | | | | | | |
| 1 | | | | | | | | | | | | |
| 2 | | | | | | | | | | | | |
| 3 | | | | | | | | | | | | |
| 4 | | | | | INPUT-DIGIT | | | | | | | |
| 5 | ones | DISPLAY | | | DIGIT-COUNTER | | | | sec. 1 | STOPWATCH | | |
| 6 | tens | | | | START FLAG | | | | sec. 10 | | | |
| 7 | hundreds | | | | IN-R4 | | | | min. | | | |
| 8 | ones | COUNTER | | | ones | DIGIT | | | | | | |
| 9 | tens | | | | tens | | | | | | | |
| 10 | hundreds | | | | hundreds | | | | | | | |
| 11 | ♩= FLAG | S/S FLAG | 1st PUSH FLAG | DELAY | EQUALITY | | | | | | | |
| 12 | B♭ FLAG | 1st ♩= FLAG | BUTTON PUSH | E FLAG | | | | | | | | |
| 13 | | | BUTTON RELEASE | | 200-259 | APPROX. | | | | | | |
| 14 | DISPLAY-REG. | | | | 100-199 | | | | | | | |
| 15 | 100 STROBE | 10 STROBE | 1 STROBE | DP STROBE | 30-99 | | | | | | | |

Fig. 11

ELECTRONIC METRONOME

THE INVENTION

This invention relates to an electronic metronome in which the beat frequency is displayed via a digital indicator and selected either by entering the required frequency via a digital keypad input means or a mimic means wherein an operator generates a single beat interval by causing the device to create a first and second beep and the interval thus created is mimicked as the beat frequency.

BACKGROUND OF THE INVENTION

Historically, the classical metronome has been a mechanical pendulum device which creates a beat as it swings back and forth at a tempo which is adjusted by positioning a weight on the pendulum arm. This early type of metronome usually includes a calibrated scale whereby the weight position will indicate the set tempo. Due to physical limitations, this type of indicating means is restricted to coarse frequency indications.

Early mechanical metronomes have given way to electro-mechanical devices wherein the tempo is chosen by setting a dial on the instrument. This device is also limited by the physical dimensions of the dial so that only coarse tempo selections may be made over a relatively broad range.

Neither of the above types of metronomes have the capability of measuring the tempo produced by other means. One such device is in existence which can provide an indication of tempo and that is the tempowatch created by Cecil Effinger of Boulder, Colo. This is a stop watch with a recalibrated face. A user activates the stop watch at the beginning of a beat and allows the watch to run for six beats and then stops the watch. The recalibrated face then provides a reading in beats per minute. This device provides no other indication of tempo nor will it produce a tempo.

The relatively simple metronome and beat determining devices have been duplicated to varying extents by electronic means utilizing contemporary technology. For instance, the features found in the simple mechanical or electro-mechanical metronome may be found in electronic metronomes such as the type typified by U.S. Pat. No. 4,018,131 issued to R. L. Cannon on "Electronic Metronome". This device is a variable oscillator in combination with a speaker wherein the oscillatory circuit is adapted to provide periodic impulses to the speaker at a beat recurrent frequency rate within the normal metronome range of 40 to 208 beats per minute.

U.S. Pat. Nos. 4,014,167; 4,090,355; 4,204,400; and 4,218,874 on "Electronic Metronome" issued to R. Hasegawa et al; F. Morohoshi; F. Morohoshi et al and S. Ishida et al respectively are more elaborate adaptations of the concept presented in Cannon wherein an oscillator provides a beat output via an amplifier to a loud speaker and the beat repetition rate is controlled either by controlling the oscillator frequency or incorporating a variable divider between the oscillator and amplifier circuitry.

P. Watkins, U.S. Pat. No. 4,193,257 on "Programmable Metronome" advances the state of the art by providing a plurality of variable rate time pulse generators which may be used to activate different sound generating devices so that up and down beats may be produced. Watkins offers the further improvement of providing a digital indication of the cadence but the device is limited in that only a few cadences are available for selection.

T. Sasaki et al, U.S. Pat. No. 4,213,372 on "Electronic Type Music Learning Aids" incorporates contemporary technology to provide a means whereby musical information may be entered into a storage means in a digital fashion and extracted therefrom in the form of a visual display and tone.

All of the prior metronome systems, as exemplified by the foregoing, fail to provide an accurate metronome wherein an exact cadence or repetition rate may be selected via a digital keyboard and indicated via a digital readout means or selected by playing a one beat interval manually on the metronome, after which the metronome automatically repeats the cadence and provides a digital indication of the beat frequency.

OBJECTIVES OF THE INVENTION

In view of the obvious inability of the prior art systems to provide a programmable metronome wherein the beat frequency may be selected by entering the desired frequency via a keyboard input means or by manually causing the metronome to play a single beat sequence at the desired beat frequency, it is a primary objective of the present invention to provide an electronic metronome capable of providing those functions.

A further objective of the present invention is to provide an electronic metronome incorporating a digital readout for visually displaying the set beat frequency.

A still further objective of the present invention is to provide an electronic metronome incorporating a digital stopwatch.

Another objective of the present invention is to provide an electronic metronome incorporating a digital stop watch adapted to measure the time increment between a manually activated first and second beep and set the metronome beat frequency to duplicate the time increment.

A still further objective of the present invention is to provide an electronic metronome incorporating means whereby the source of said beat frequency generating means may be adapted to provide selected ones of a plurality of tones for pitch comparison.

The foregoing and other objectives of the invention will become apparent in light of the drawings, specification and claims contained herein.

SUMMARY OF THE INVENTION

The metronome presented herein incorporates a microcomputer controlled by a dedicated programmable read-only memory. A keypad input means selects desired operations of the system wherein a selected one of a plurality of tones may be digitally generated and played over a speaker, a stop watch function may be initiated and stopped and elapsed times displayed via a digital readout means, a desired beat frequency may be entered to cause a metronome cadence output via the speaker means and energize the digital readout means so that the beat frequency is displayed, or provide a mimic cadence function. In the mimic cadence function, activation of a predetermined key on the keypad causes a first beep to be generated and release of the key causes a second beep to be generated. The stop watch function of the system measures the time interval between the two beeps, displays the interval as a beat repetition rate and causes the metronome function of the system to produce a continuing series of beeps at the beat repetition rate displayed.

DESCRIPTION OF THE DRAWINGS

FIG. 11 is a map indicating the use of the random access memory of the microcomputer.

DESCRIPTION OF THE INVENTION

Figure 1:
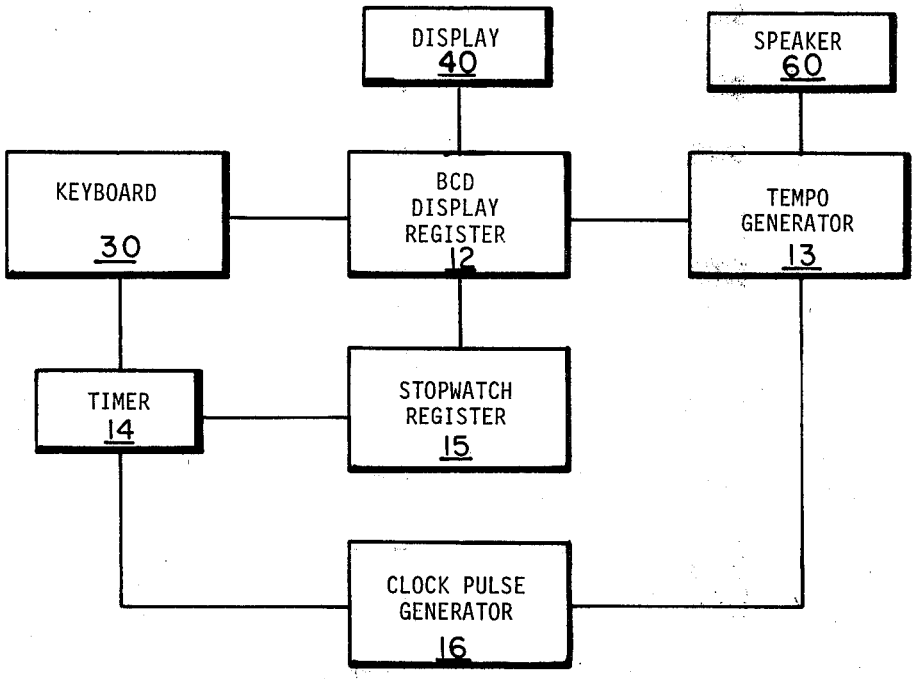
FIG. 1 is a simplified block diagram depicting the interconnection of the primary circuits of the present invention.

The primary elements of the electronic metronome are presented in the simplified block diagram of FIG. 1. The keyboard 30 provides a means for entering into display register 12, a binary coded digital (BCD) value representing a desired tempo in beats-per-minute. The BCD data in the display register is coupled to a seven-segment digital display 40 to provide a visual indication of the selected beats-per-minute or tempo. The contents of display register 12 are also used to regulate the operation of the tempo generator 13 so that periodic signals are applied to speaker 60 to cause it to emit beeps at a rate equal to the beats-per-minute of the display.

Keyboard 30 includes a means to activate and de-activate timer 14, in addition to providing a digit input for the display register 12. When timer 14 is activated, it functions as a recirculating register, accumulating pulses from the clock pulse generator 16 and incrementing the stop watch register 15 each time it accumulates the number of pulses from the clock pulse generator that equal one second. When incremented, stop watch register 15 creates a binary coded decimal display code representing elapsed time. When the timer is halted by the action of keyboard 30, the contents of the stop watch register 15 are transferred to display register 12 and a digital display is created, representing beats-per-minute with a time period between each beat equal to the duration of time that timer 14 was permitted to run by keyboard 30.

The binary coded digital data in display register 12 is used to regulate the output of the tempo generator 13 in response to a keyboard entered digital number, or in response to a value entered therein from the stop watch register 15 on command from the keyboard. The tempo generator 13 accumulates pulses from the clock pulse generator 16 and in response to a predetermined number of pulses dictated by the contents of display register 12, produces an output pulse to activate speaker 60. Thus the system of the present invention is capable of causing the tempo generator to provide a predetermined cadence based on a keyboard input of the beats-per-minute desired or a timer input timing the elapsed time between a first and second timing signal from the keyboard which may be a first and second beat of the desired tempo.

Figure 2:
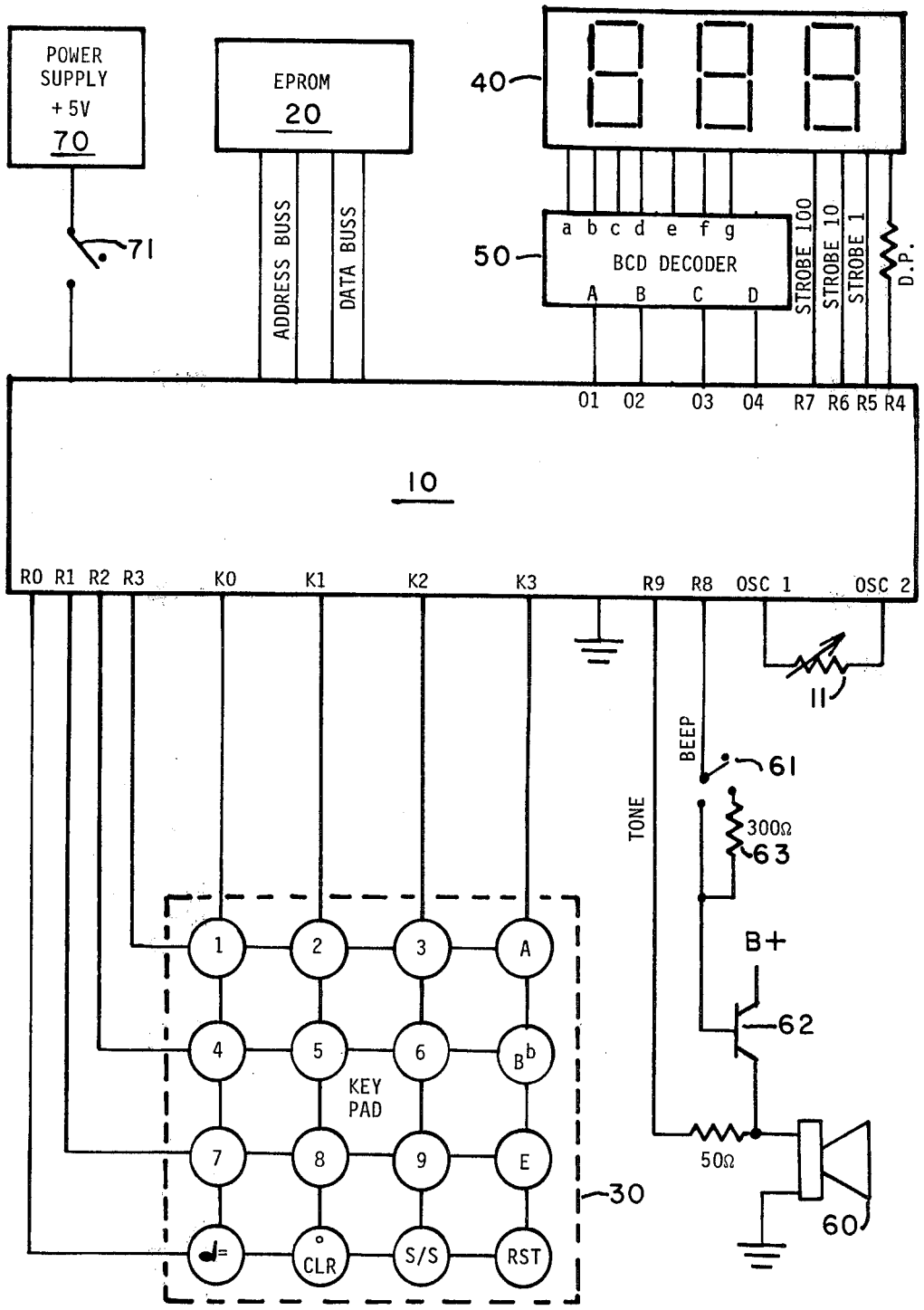
FIG. 2 is a schematic diagram of an exemplary embodiment of the present invention.

FIG. 2 illustrates the electrical interconnection of the primary components of the electronic metronome. The metronome is built around a Motorola type MC141099 single chip microcomputer 10, the operation of which is governed by a dedicated external programmable read-only memory 20.

Instruction inputs to microcomputer 10 are provided by a 4×4 keypad 30 and microcomputer outputs are provided via a three digit, solid state, numeric indicator 40 such as a Hewlett Packard type 5082-7433 which is a three-digit, seven-segment, monolithic, light-emitting diode device. Each digit of the display 40 is individually strobed by microcomputer 10 at a repetition rate fast enough so that the display appears to be constantly illuminated.

The microcomputer 10 provides a binary coded digital output to a BCD-to-7-segment decoder 50 such as an SN7447 which drives each of the individual segments of display 40 in a parallel fashion where individual number segments are selectively energized as a function of the combined input of the parallel outputs from the decoder 50 and strobe inputs from the microcomputer 10.

The microcomputer 10 may be used to provide a selected one of a plurality of tones via keys A, B♭, or E of keypad 30. The microcomputer 10 also generates on command, a series of beeps at a selected repetition rate. The selected tone is applied to the loud speaker 60 via a resistor and the beeps are applied through a control switch 61 which selectively connects the beep signals directly to the speaker 60 via transistor amplifier 62 or via an attenuating resistor 63 to transistor amplifier 62.

The electronic components of the system require a positive 5 volt potential which is supplied by power supply 70 through the on-off control switch 71.

When power is applied to the metronome via switch 71, the dedicated circuits of the external programmable read-only memory 20 causes the microcomputer to run through a series of routines that clear random access memories, RAM 0, RAM 1, and RAM 2 of FIG. 11. The external programmable read-only memory 20 of FIG. 2 then causes the microcomputer 10 to enter a loop whereby microcomputer pins $R_0$, $R_1$, $R_2$, and $R_3$ are sequentially scanned which causes the 4×4 keypad 30 to be scanned. The display indicator 40 is strobed sequentially via the $R_4$, $R_5$, $R_6$, and $R_7$ outputs of the microcomputer 10.

Keypad scanning is accomplished by sequentially applying in a mutually exclusive fashion, a high or +5 volts to $R_0$, $R_1$, $R_2$, and $R_3$ of the microcomputer 10. If a key is depressed, this high is sensed on the $K_0$, $K_1$, $K_2$ or $K_3$ inputs to the microcomputer and stored in the INPUT register RAM 1. For instance, if the ♩ = key is depressed, then when $R_0$ is high, $K_0$ will be high and bit 0 of the RAM 1 word 0 will be set. If the CLR key is depressed, the high on $R_0$ will be sensed by the $K_1$ input and bit 1 of the RAM 1 word 0 will be set. Keys S/S and RST function in a similar fashion setting RAM 1 word 0 bit 2 and RAM 1 word 0 bit 3 locations respectively. The remaining three horizontal rows of keys affect words 1, 2, and 3 in RAM 1 in the same fashion as described for the row strobed by $R_0$.

The scanning or strobing procedure is repeated for each of the horizontal rows of the keypad until a key is depressed and an input is detected. When this occurs, BUTTON-PUSH or bit 2 of word 12 in RAM 0 is set. This inhibits any further input by a single button push being scanned more than once. When the button is released, BUTTON-RELEASE or bit 2 of RAM 0 word 13 is set which causes BUTTON-PUSH to be reset and the system is enabled so that it may receive a second keyboard input.

Each time BUTTON-PUSH is set, the input is analyzed to determine which key was pushed by testing each bit in the INPUT register or RAM 1 words 0, 1, 2, and 3 for RAM 1 word bits 0, 1, 2, and 3. When the proper bit is found, it results in a branch to the proper routines in accordance with FIG. 3.

The strobe display routine is controlled by the DISPLAY-REG, word 14 of RAM 0. This word is used as a counter to determine which display digit in the indicator is to be strobed. After being strobed, the DISPLAY-REG register is decremented to indicate that the next display will be strobed upon the next entry of the display routine. When a digit is ready to be strobed, the corresponding bit in RAM 0 word 15 is tested to find if that digit is suppose to contain a display. If the answer is yes, the corresponding digit in the DISPLAY register, RAM 0 words 5, 6, and 7 is sent to the BCD outputs of computer 10. The proper strobe lead is reset (Strobe 1, Strobe 10, or Strobe 100) to create the potential difference necessary to light the light-emitting diodes in one display digit. The BCD information at the $0_1$, $0_2$, $0_4$, and $0_8$ outputs of microcomputer 10 is converted to a seven-segment energizing parallel signal by decoder 50 as previously discussed. The strobe display routine is repeated at least 50 times per-digit per-second to ensure a visually continuous display.

Figure 3:
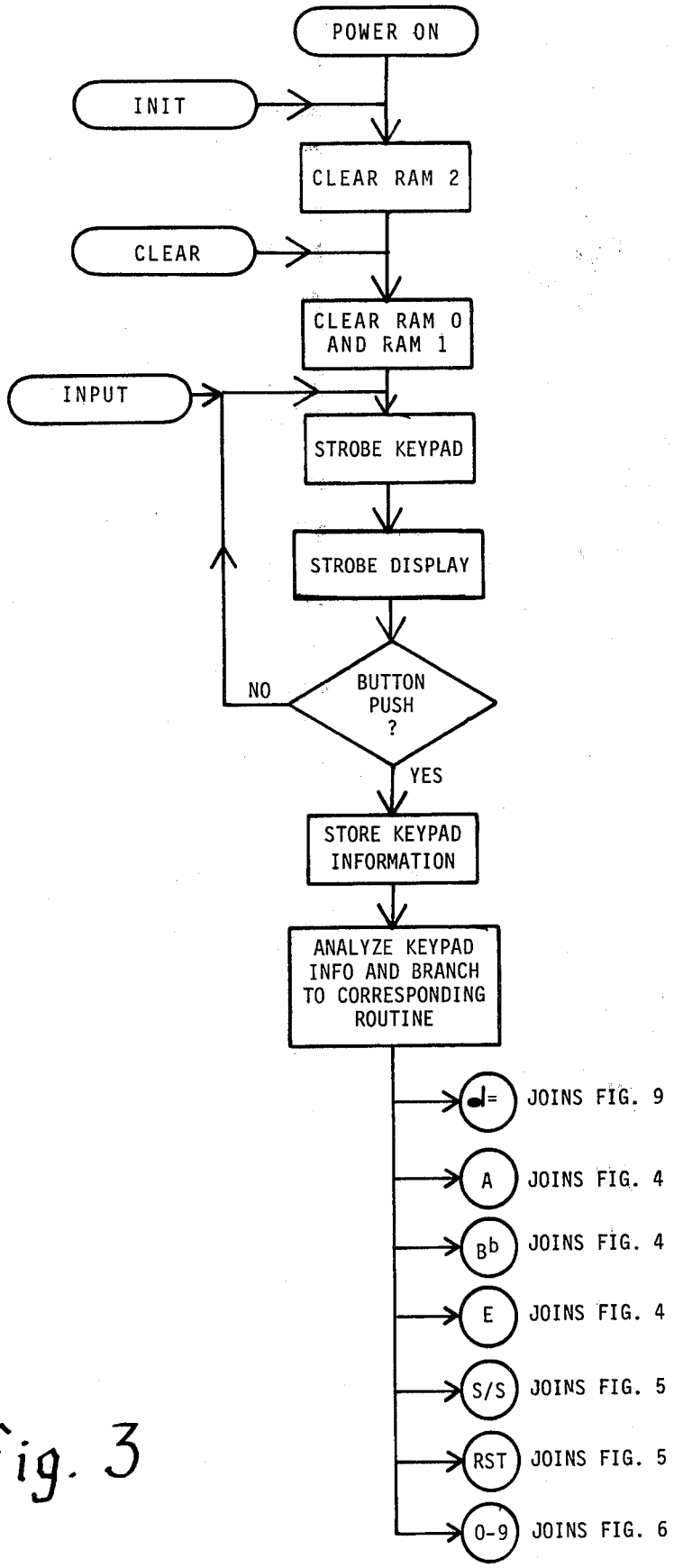
FIGS. 3 thru 10 are the program flow diagrams depicting the logic of the functioning of the microcomputer.

If the A, B♭ or E key is depressed, the corresponding bit in RAM 1 is set as previously explained and a branching occurs at the A, B♭ or E branch of FIG. 3. This results in a corresponding operation in FIG. 4 which sets a flag if appropriate and in all cases sets $R_9$ to cause the selected tone to be coupled to speaker 60 and strobe the keypad. When the B♭ flag is set, this results in setting the 0 bit of word 12 in RAM 0 and the E flag results in setting bit 3 of word 12 of RAM 0. When $R_9$ is set, after the keypad is strobed according to FIG. 4, a 74 step delay is executed. To simplify this presentation, all delays include the time required by any other function going on. Thus the keypad strobe time is included in the 74 step delay.

The internal clocking of the system is set at 467.28 khz. Each step or instruction requires six clock pulses. Therefore, 77,880 steps-per-second are executed and this results in an instruction time of 12.84 μsec.

After the 74 step delay, tone $R_9$ is reset. This starts the lower half of a square wave and a 44 step delay is executed and E-FLAG is tested. If E-FLAG is set, then a branch back to the beginning of the tone routine is executed, see FIG. 4, and tone $R_9$ is again set, starting the next cycle of the square wave. This creates a total cycle of 118 steps for E, resulting in a frequency of 77,880 divided by 118 or 660 hz, the pitch of E.

Figure 4:
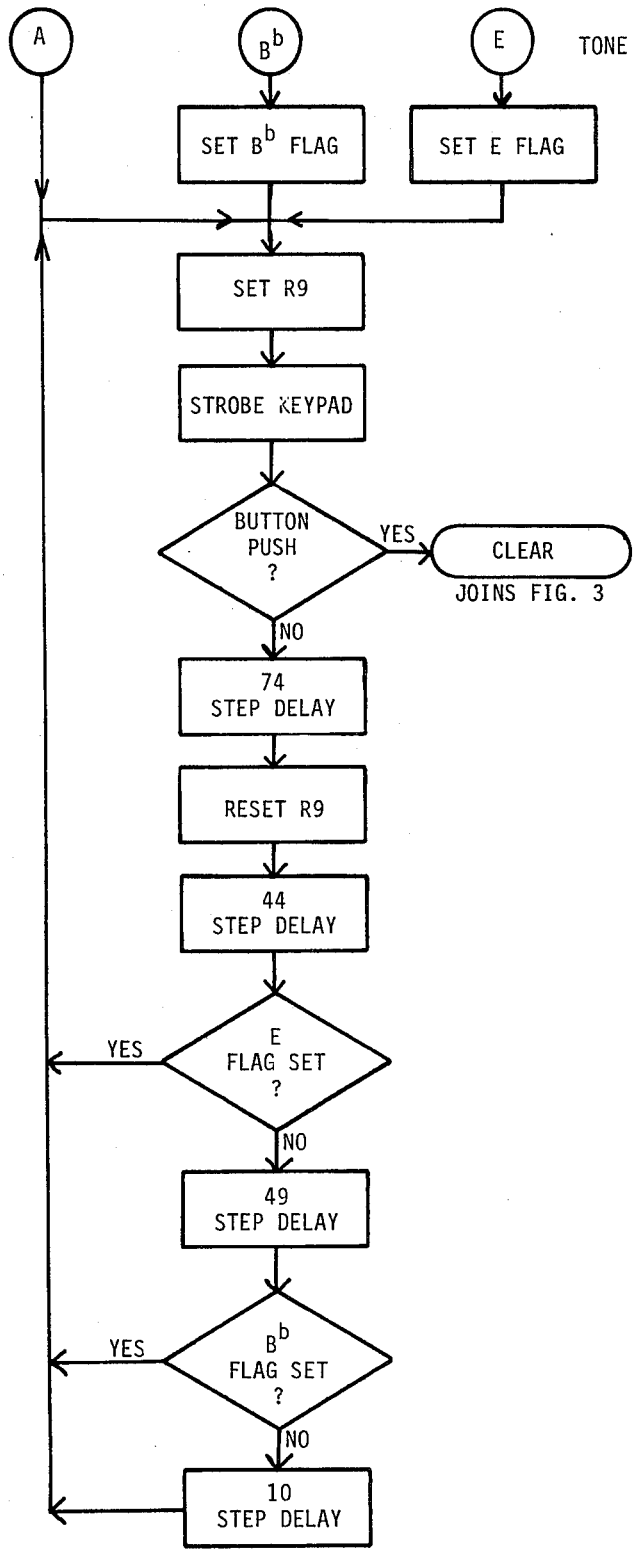

As can be seen in FIG. 4, if E-FLAG was not set, the program executes an additional 49 step delay and then tests for B♭-FLAG. If set, the branch will be executed to create a cycle of 167 steps, which produces a frequency of 466.35 hz or the B♭ pitch.

If B♭-FLAG is not set, a further 10 step delay is executed to create a cycle having 177 steps. This equates to a 440 hz tone which is the A pitch.

The keypad is scanned every cycle and if a button-push is detected, the tone routine is terminated by a branch to clear from FIG. 4 to FIG. 1 and RAM 0 and RAM 1 are cleared. RAM 2, which contains the stop watch memory, is not cleared by this action. The button-push would again be detected (in this case BUTTON-RELEASE would be overriden). As before, the button-push would be analyzed, and a branch to the proper routine would occur. If the key depressed was the S/S key, the branch would be to the stop watch routine of FIG. 5.

Figure 5:
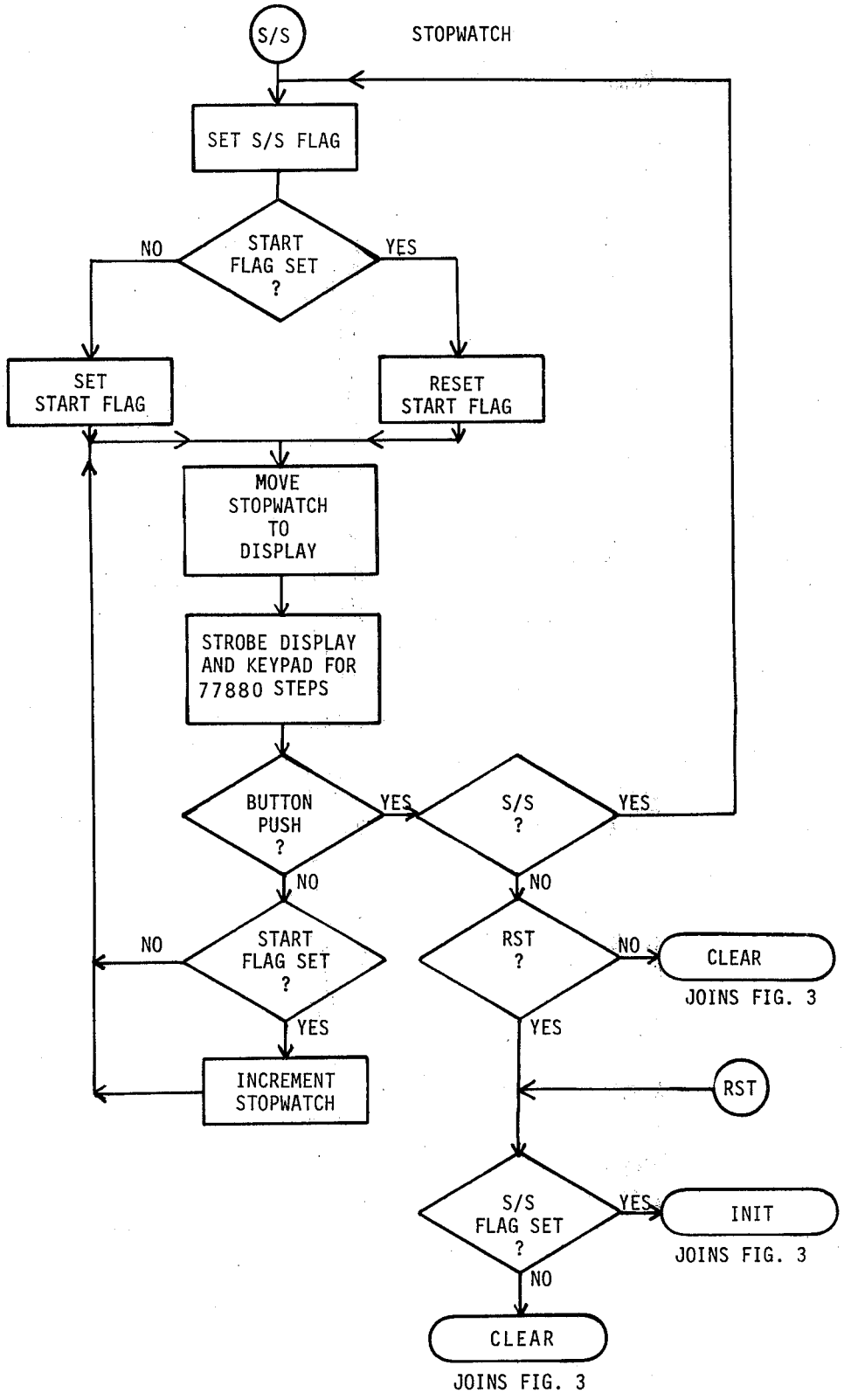

In this case, S/S FLAG will be set in RAM 0, word 11, bit 1 of FIG. 11. In FIG. 5, with S/S FLAG set, a check is made to see if START-FLAG is set. If this flag is not set, then START-FLAG is set and STOP WATCH (RAM 2 words 5, 6, and 7) are moved to the DISPLAY register (RAM 0, words 5, 6, and 7). If this is the first entry into the stop watch routine, the STOP WATCH register of RAM 2 would be all 0's. If the stop watch had been running, then the STOP WATCH register would contain some value and counting would resume from that value. Note that the value is displayed in indicator 40 as previously explained.

A 77,880 step delay (1 second) is executed, during which time the keypad and display are continuously strobed. At the end of 1 second or 77,880 steps, START-FLAG is tested, see FIG. 5. If it is set, then the STOP WATCH register in RAM 2 is incremented, taking into consideration carry over from seconds to minutes. A branch is then executed to repeat the 1 second cycle. The new value in the STOP WATCH register is loaded into the DISPLAY register of RAM 0 and display 40 is changed to reflect the current STOP WATCH value.

If a button-push is now detected, it is tested for S/S. If the answer is yes, an immediate branch back to the beginning of the stop watch routine is executed. The START-FLAG is tested and if it is found to be a 1, the YES branch will be taken to cause START-FLAG to be reset, indicating a stop mode. When START-FLAG was tested at the end of the stop watch routine, the NO branch would have been taken, thus bypassing the STOP WATCH increment.

If the RST key is pushed while in the stop watch mode, an immediate branch to RST of FIG. 5 is executed. The S/S-FLAG is tested. If it is set as it would be if the stop watch were running, a branch to INIT of FIG. 3 is executed and all memory, including the STOP WATCH register is cleared. If RST is entered at any other time, the S/S-FLAG would not be set and a branch to CLEAR of FIG. 3 would result, keeping the STOP WATCH register contents intact.

Figure 6:
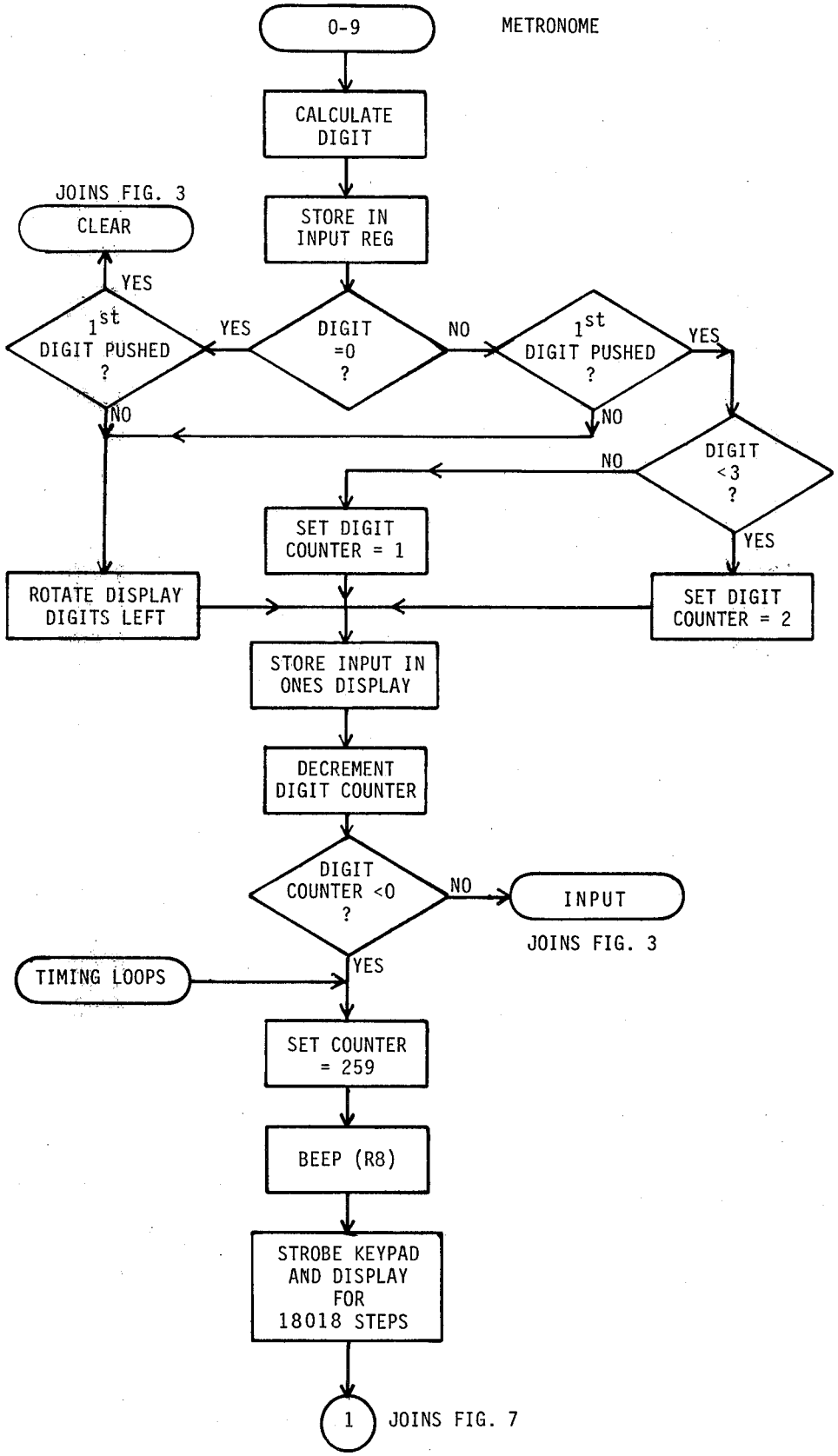

The metronome cadence routines result in the basic pulse train that is the beating of the metronome and they begin at TIMING LOOPS of FIG. 6. This point in the program can be reached either by a digital entry, or by pushing of the ♩ = key for one beat.

If the metronome is to be controlled by a digital entry, the flow of FIG. 3 will progress to the 0–9 which is the metronome control input of FIG. 6. The digit is calculated and the first digit entered determines whether the system will expect a 2 digit command or a 3 digit command. If the first digit entered is a 1 or a 2, a 3 digit command will be expected because the system is designed to provide a frequency of 30 thru 259 beats-per-minute. The resultant beats-per-minute keypad entry is stored in the DISPLAY register of RAM 0 and used to control display 40 as previously explained. The digits are stored in such a way that they appear in the right most digit display upon entry and are shifted left upon entry of subsequent digits. The first digit is checked in the logic system to determine if the tempo is a 3 digit number (100 thru 259) or a 2 digit number (30 thru 99) as previously suggested.

After the entry of each digit, but before the entire tempo has been entered, a branch is made to INPUT of FIG. 3. The keypad and display are strobed, but no memory is cleared. After the final digit is entered, the DISPLAY register holds the 2 or 3 digit tempo, and TIMING LOOPS of FIG. 6 is reached.

Figure 9:
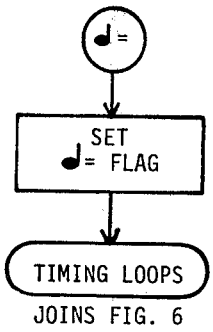

If the entry into the metronome function is via the ♩ =key instead of digitally via the keypad, then ♩ = FLAG of FIG. 9 is set before moving on to TIMING LOOPS of FIG. 6.

Figure 12:
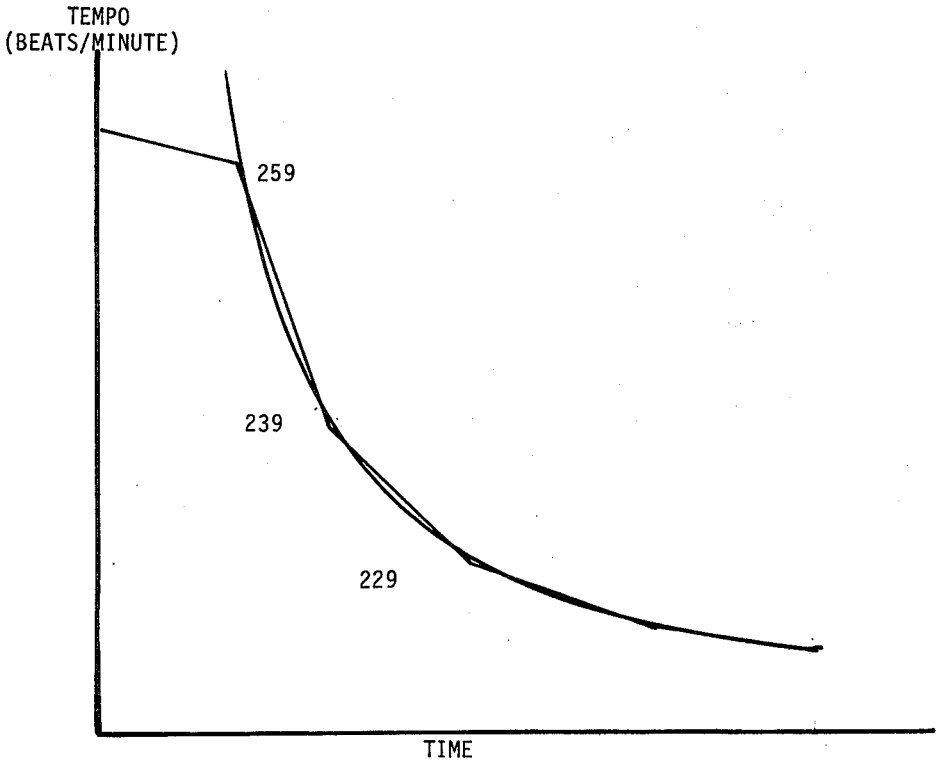
FIG. 12 is a curve depicting the linear approximation used in the microcomputer to minimize storage requirements for the tempo timing loops.

Since it is impossible to fit all of the timing loops for 230 separate tempos into 1,000 words of program memory, a linear approximation of the 60/t curve is made, see FIG. 12. The approximation is made with the use of a counter register in memory called COUNTER. It occupies RAM 0 words 8, 9, and 10. This counter is set to 259 after a delay of 231.7 msec (the period between 2 beats at 259 beats-per-minute) and starts counting down at a rate of 1.07 msec-per-decrement. In this manner, the down counter closely follows the 60/t curve. At 239 beats-per-minute, the linear approximation begins to deviate from the 60/t curve and to compensate for this, additional delay is added between successive decrements of the down counter, bringing the rate to 1.21 msec-per-decrement. This shifts the angle of the linear approximation so that the 60/t curve is still closely followed. This procedure is repeated throughout the 60/t curve until 30 is reached, resulting in 23 linear segments. The delays which are added for the segments are presented in the following table.

| Tempos from - to | Delay added per decrement |
|---|---|
| 259-239 beats/min | 83 steps |
| 239-229 | 11 |
| 229-219 | 7 |
| 219-209 | 10 |
| 209-199 | 9 |
| 199-189 | 12 |
| 189-179 | 14 |
| 179-169 | 16 |
| 169-159 | 20 |
| 159-149 | 23 |
| 149-139 | 28 |
| 139-129 | 35 |
| 129-119 | 44 |
| 119-109 | 55 |
| 109-99 | 73 |
| 99-89 | 95 |
| 89-79 | 135 |
| 79-69 | 190 |
| 69-59 | 228 |
| 59-49 | 455 |
| 49-39 | 811 |
| 39-34 | 1497 |
| 34-30 | 830 |

From TIMING LOOPS of FIG. 6, the COUNTER register is set to 259, and a beep tone is sent out on the beep lead $R_8$ in the form of a square wave having a frequency of 1384 hz for 10.67 msec. During the time that the tone is being produced, the display 40 is disabled, resulting in a blink. After the tone, there is a delay of 18,018 steps or 231.4 msec, which is approximately 259 beats-per-minute.

Figure 7:
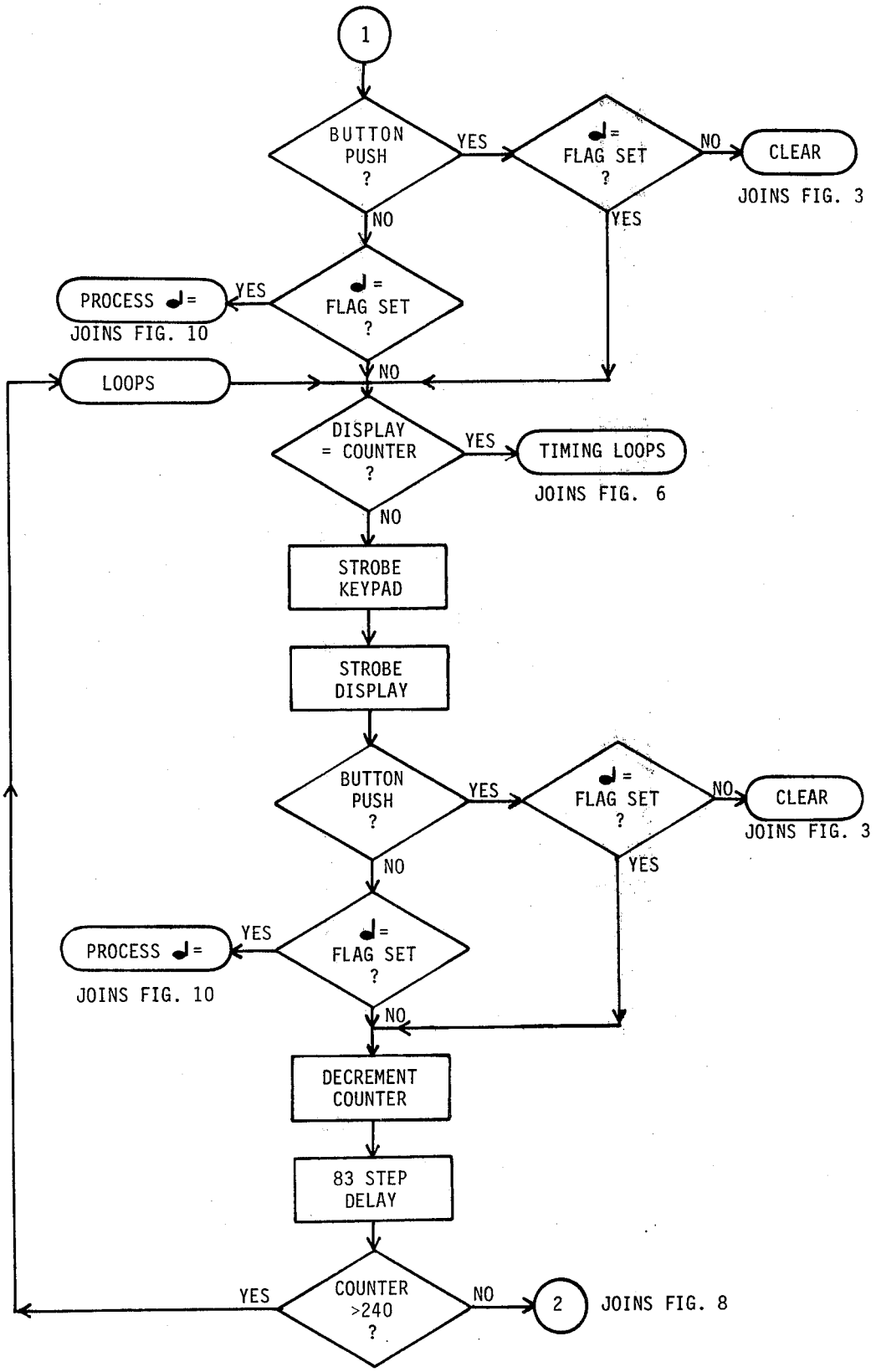
Figure 8:
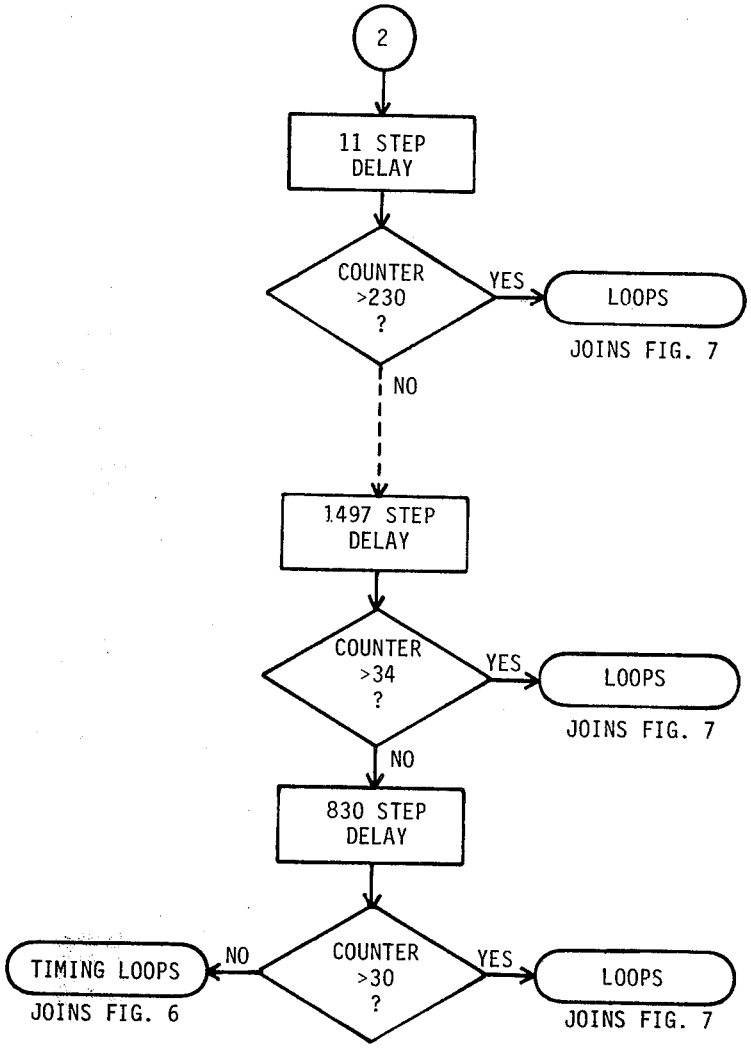
Figure 10:
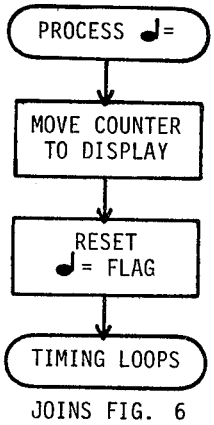

After the delay, the contents of the DISPLAY register are compared with the contents of the COUNTER register. If they are equal (DISPLAY=COUNTER=259 beats-per-minute for the first comparison), a branch is made back to TIMING LOOPS of FIG. 6 where another beep is executed and the timing is repeated. If they are not equal (some tempo less than 259), another keypad and display strobe is executed as before, then the COUNTER register is decremented (to 258 in this case). An 83 step delay is executed, and the COUNTER register is tested for greater than 240. Since the contents of the COUNTER register is greater than 240, a branch to LOOPS of FIG. 7 is executed. The system has now processed through 18,101 steps or 232.4 msec, which is approximately 258 beats-per-minute. The COUNTER register is again decremented (to 257) and another 83 step delay is executed with a branch back to LOOPS of FIG. 7 again being made. Again, the contents of the COUNTER register is compared with the contents of the DISPLAY register. If they are equal, a branch is made to TIMING LOOPS of FIG. 10 for another beep.

If no equality is found between the contents of the COUNTER register and the DISPLAY register, the COUNTER register will eventually be decremented past 240. When this occurs, an 83 step delay is initiated and the contents of the COUNTER register is checked for a value greater than 240 and an 11 step delay follows. This additional delay represents the change in the linear approximation of the 60/t curve as previously explained and indicated in FIG. 12 and the delay table. As the COUNTER register is decremented past successive check points, more delay is added as previously explained.

While the TIMING LOOPS routines are running, if a button-push is detected and ♩ = FLAG is set, it is assumed that the system is in the first beat of an automatic tempo entry and the timing continues. If there is a button-push and ♩ = FLAG is not set, a new entry is assumed and a branch to CLEAR of FIG. 3 is executed. If no button-push is detected but ♩ = FLAG is set, then it is assumed that the ♩ = key has just been released and a branch is made to PROCESS ♩ = of FIG. 10. If no button-push is detected and ♩ = FLAG is not set, timing continues.

If the ♩ = key was pushed and released after 986.4 msec, the COUNTER register would have reached 61 and the release would be detected by a keypad strobe. After checking for ♩ = FLAG, a branch to PROCESS ♩ = of FIG. 10 would be executed. The contents of the COUNTER register is moved to DISPLAY, ♩ = FLAG is reset, and a branch back to TIMING LOOPS of FIG. 7 is made. At this time, the system will progress in the same manner as if a digital entry of 61 was made.

In summary, the operation of the microcomputer is controlled by internal clocking set at 467.28 khz by variable resistor 11 and the metronome is controlled by a 16 key keypad. Keys labeled 9-0 are used for one mode of operation providing numerical entry of a desired metronome tempo within a range of 30 to 259 beats-per-minute.

The first numerical key depressed places a digit in the right most display. The second key depressed shifts the first digit into the middle display, and puts the second digit into the right most display. If the intended tempo was 30 to 99 beats-per-minute, the second key depressed will automatically trigger the series of beeps marking the tempo. The display 40 blinks off momentarily during each beep.

If the intended tempo was 100 to 259 beats-per-minute, the metronome will wait for the third key to be depressed. The third key pressed will again shift the digits left, placing the third and final digit into the right most display, triggering the series of beeps and the flashing display.

The key labeled CLR will do one of two things, depending upon when it is pushed. If the key is depressed during a numerical tempo entry, then it responds as a numerical 0. For instance, as the second key pushed in the numerical entry of 209 beats-per-minute, if the CLR key is depressed at any other time, it functions as a clear key, clearing the display and halting whichever operation (tone, stop watch, or beeping) is active. The clear key will not reset the STOP WATCH register.

The keys labeled A, B$^b$, and E results in the corresponding tone being produced. The tones are 440 hz, 466.35 hz and 660 hz respectively. A tone can be halted or changed by pushing any other key.

A 10 minute stop watch function is provided by keys labeled S/S and RST. Depressing S/S results in a display of minutes and seconds which increment each second. Depressing S/S again stops the second increments. Pushing S/S once again starts the counting, and so forth.

If CLR is pushed while in the stop watch mode, the display will be cleared, but the stop watch value will be stored in memory so that it resumes counting from its last value when the S/S key is again pushed.

If the RST key is pushed while in the stop watch mode, the display will be cleared and memory will be reset to 0 minutes and 0 seconds.

Automatic tempo entry or the second mode of operation is controlled by the key labeled ♩ =. When this key is depressed, the metronome beeps once. When it is released, the metronome beeps again. A display appears corresponding to the length of time between the two beeps and a series of beeps in tempo with the first two beeps result. The tempo can be changed by pressing the ♩ = key once again, or pushing CLR and re-entering a new tempo.

The metronome may be powered by any convenient DC power source such as a battery pack and the battery pack may be recharged by an AC charging adapter.

While a preferred embodiment of this invention has been illustrated and described, variations and modifications may be apparent to those skilled in the art. Therefore, I do not wish to be limited thereto and ask that the scope and breadth of this invention be determined from the claims which follow rather than the above description.

What I claim is:

1. A programmable metronome, comprising:
- a display register;
- keyboard entry means for placing a binary coded digital value in said display register;
- a timer adapted to be started and stopped by said keyboard;
- a stop watch register incremented in a binary coded digital manner by said timer;
- means for transferring the contents of said stop watch register into said display register; and
- tempo generator means responsive to the contents of said display register for producing a repetitive cadence having a repetition rate in beats-per-minute approximating the digital value of the contents of said display register.

2. A programmable metronome, as defined in claim 1, comprising:
- a clock pulse generator means for producing a continuous series of pulses; and
- said timer means adapted to produce said stop watch register increments in response to a predetermined number of said clock pulse generator pulses.

3. A programmable metronome, as defined in claim 1, comprising:
- a clock pulse generator means for producing a continuous series of pulses; and
- said tempo generator means adapted to produce each beat of said repetitive cadence in response to a predetermined number of said clock pulses as determined by the contents of said display register.

4. A programmable metronome as defined in claim 1, further comprising a digital display means responsive to said display register for displaying the value of the contents contained therein.

5. A programmable metronome as defined in claim 4, further comprising a speaker for emitting audio sounds in response to inputs from said tempo generator and means to inhibit said display means during periods when said speaker is activated.

6. A programmable metronome as defined in claim 1, wherein said display register, said timer, said counter register, and said tempo generator means are provided by circuitry contained in a microcomputer.

7. An electronic metronome, comprising:
- a microcomputer including first, second and third random access memories and a clock pulse generator;
- a keypad input means including a plurality of digit input keys and a plurality of special function keys;
- a digital display means including a plurality of individual digit displays, each comprised of seven optionally activated segments;
- display memory storage means in said first random access memory;
- means responsive to activation of individual ones of said digit input keys of said keypad input means for entering a binary coded digital equivalent of the value of said activated digital input keys into said display memory storage means;
- BCD decoder means for enabling said operationally activated segments of said digital display in response to the contents of said display memory storage means;
- scan memory means in said second random access memory for sequentially enabling outputs from said keypad input means;
- strobe memory means in said first random access memory for sequentially enabling each of said individual digit displays of said digital display;
- stop watch memory means responsive to the activation of one of said special function keys of said keypad input means for storing the value of an elapsed time as a binary coded digital value;
- down counter memory means for storing a binary coded digital value as it is incremented from a predetermined value toward zero by pulses from said clock pulse generator;
- fixed memory means for effecting the transfer of data from said stop watch memory storage means to said display memory storage means, the decrementing of said down counter memory means by pulses from said clock pulse generator, and the comparison of the contents of said down counter memory means with the contents of said display memory storage means;
- an audio transducer; and means for activating said audio transducer with a tone in response to the contents of said down counter memory means equalling the contents of said display memory storage means.

8. An electronic metronome as defined in claim 7, further comprising:

audio tone generating means responsive to selected ones of said special function keys for synthetically producing a specific tone in response to activation of a specific one of said special function keys by dividing the output of said clock pulse generator; and means to couple said specific tone to said audio transducer.

9. An electronic metronome as defined in claim 8, further comprising:

said plurality of special function keys include three tone keys; and means to cause said clock pulse generator output to be divided by a different function in response to each one of said tone keys whereby said transducer is caused to produce a 440 hz tone, or a 466.3 hz tone, or a 660 hz tone.

* * * * *